US006415441B1

(12) United States Patent
Nelson

(10) Patent No.: US 6,415,441 B1
(45) Date of Patent: Jul. 9, 2002

(54) KNEE PROTECTING DEVICE

(76) Inventor: Kevin S. Nelson, 12001 SW. Hwy., Palos Park, IL (US) 60464

( * ) Notice: Subject to any disclaimer, the term of this patent is extended or adjusted under 35 U.S.C. 154(b) by 0 days.

(21) Appl. No.: 09/965,724

(22) Filed: Sep. 27, 2001

(51) Int. Cl.[7] ..... A41D 13/00
(52) U.S. Cl. ..... 2/22; 2/24
(58) Field of Search ..... 2/22, 16, 24, 455, 2/242, 59, 46, 908, 911; 128/878, 882; 602/23, 26, 62

(56) References Cited

U.S. PATENT DOCUMENTS

| | | | | | |
|---|---|---|---|---|---|
| 5,269,322 | A | | 12/1993 | Mandel | |
| 5,297,294 | A | * | 3/1994 | Washick | 2/22 |
| 5,301,370 | A | * | 4/1994 | Henson | 2/22 |
| 5,405,312 | A | | 4/1995 | Jacobs | |
| 5,634,211 | A | * | 6/1997 | Chen | 2/22 |
| 5,687,422 | A | * | 11/1997 | Wurst et al. | 2/24 |
| 5,732,411 | A | | 3/1998 | Coleman et al. | |
| D406,406 | S | | 3/1999 | Hettwer | |
| 5,911,310 | A | | 6/1999 | Bridgers | |
| 6,029,273 | A | | 2/2000 | McCrane | |
| 6,070,267 | A | * | 6/2000 | McKewin | 2/23 |
| 6,223,350 | B1 | * | 5/2001 | McFarlane | 2/24 |

* cited by examiner

*Primary Examiner*—Gloria M. Hale
*Assistant Examiner*—Tejash Patel

(57) ABSTRACT

A knee protecting device for removing pressure from the knees of a person who is kneeling. The knee protecting device includes a rigid panel having an inner surface and an outer surface. The panel has a first end edge, a second end edge, a first side edge and a second side edge. A pad is attached to the outer surface and is positioned generally adjacent to the first end edge. A plurality of securing members is attached to the panel for removably securing the panel to a leg.

5 Claims, 2 Drawing Sheets

FIG. 1
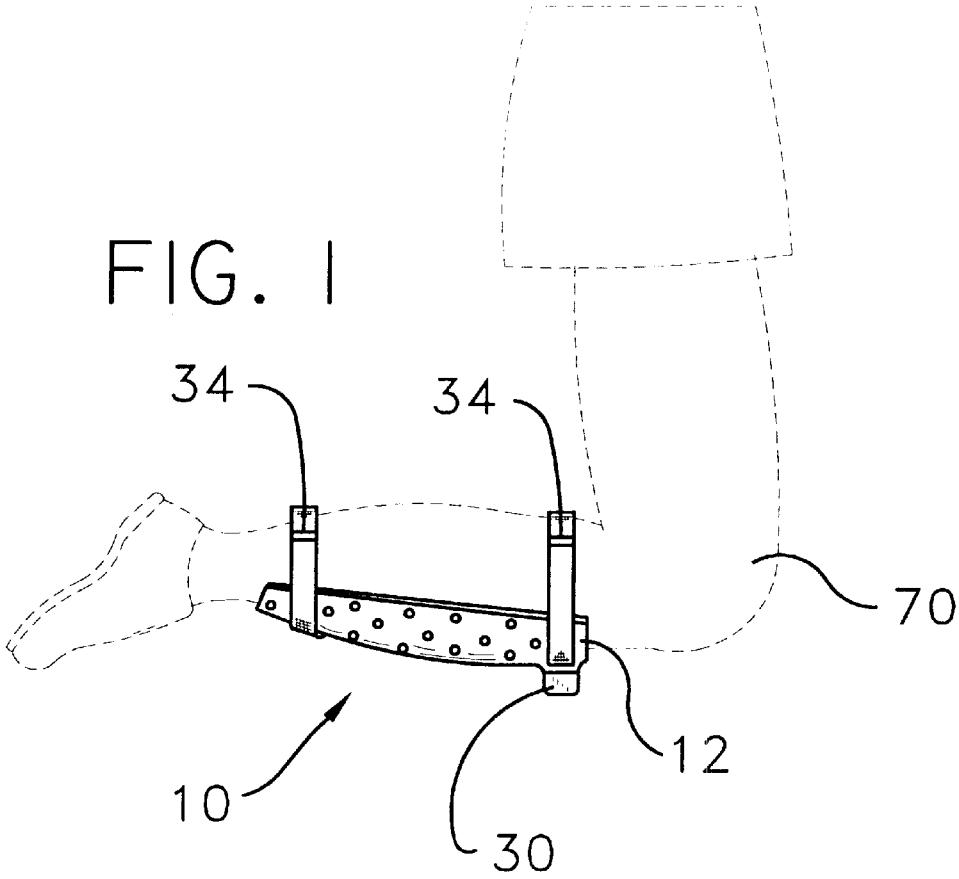
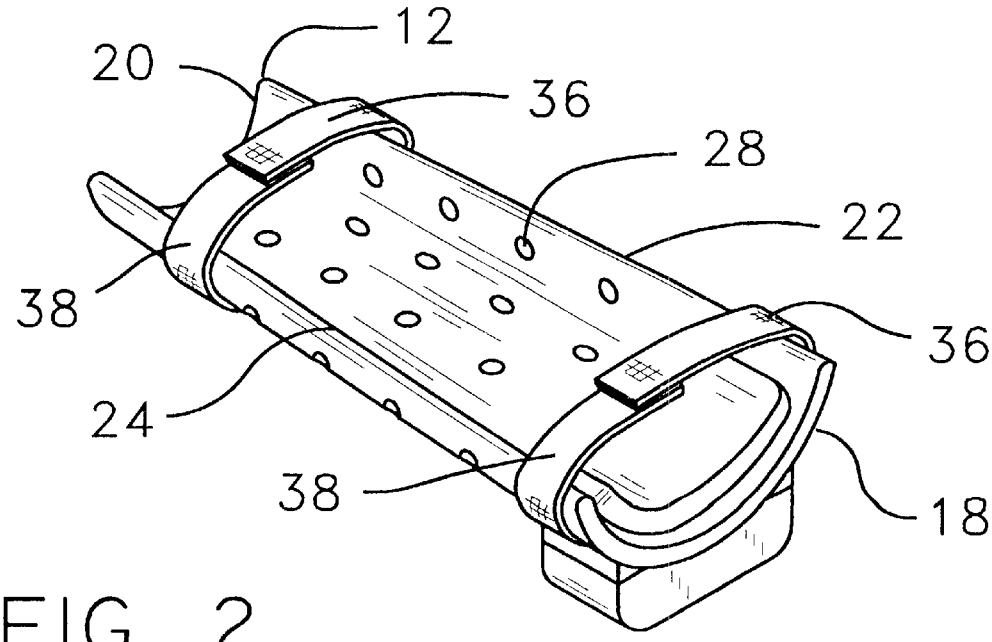
FIG. 2

KNEE PROTECTING DEVICE

BACKGROUND OF THE INVENTION

1. Field of the Invention

The present invention relates to knee protecting devices and more particularly pertains to a new knee protecting device for removing pressure from the knees of a person who is kneeling.

2. Description of the Prior Art

The use of knee protecting devices is known in the prior art. U.S. Pat. No. 5,732,411 describes a device for positioning over the knee and shin of a user for protecting the knee and shin from injury. Another type of knee protecting devices is U.S. Pat. No. 5,269,322 having a knee shroud for receiving the knee such that a person weight on their knees has less stress on their back.

While these devices fulfill their respective, particular objectives and requirements, the need remains for a device that removed pressure on the knees themselves.

SUMMARY OF THE INVENTION

The present invention meets the needs presented above by providing a pad which sits on the leg just below the knee. When the person sits on their knees, the device props the knees upwardly off of the ground and also gives a person better posture in that position.

To this, the present invention generally comprises a rigid panel having an inner surface and an outer surface. The panel has a first end edge, a second end edge, a first side edge and a second side edge. A pad is attached to the outer surface and is positioned generally adjacent to the first end edge. A plurality of securing members is attached to the panel for removably securing the panel to a leg.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a schematic side view of a new knee protecting device according to the present invention.

FIG. 2 is a schematic perspective view of the present invention.

DESCRIPTION OF THE PREFERRED EMBODIMENT

Figure 3:
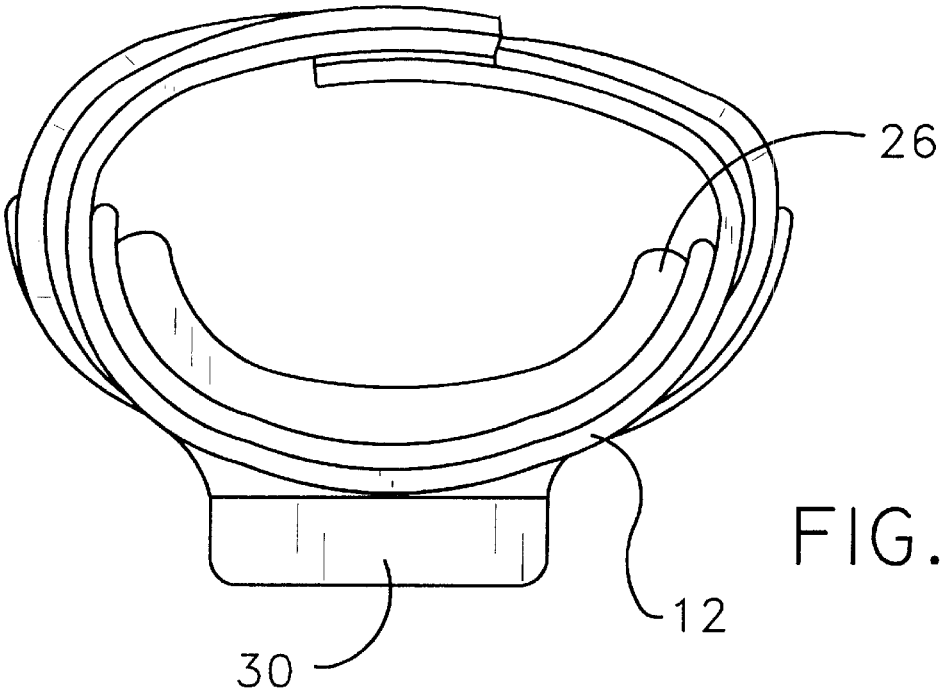
FIG. 3 is a schematic end view of the present invention.
Figure 4:
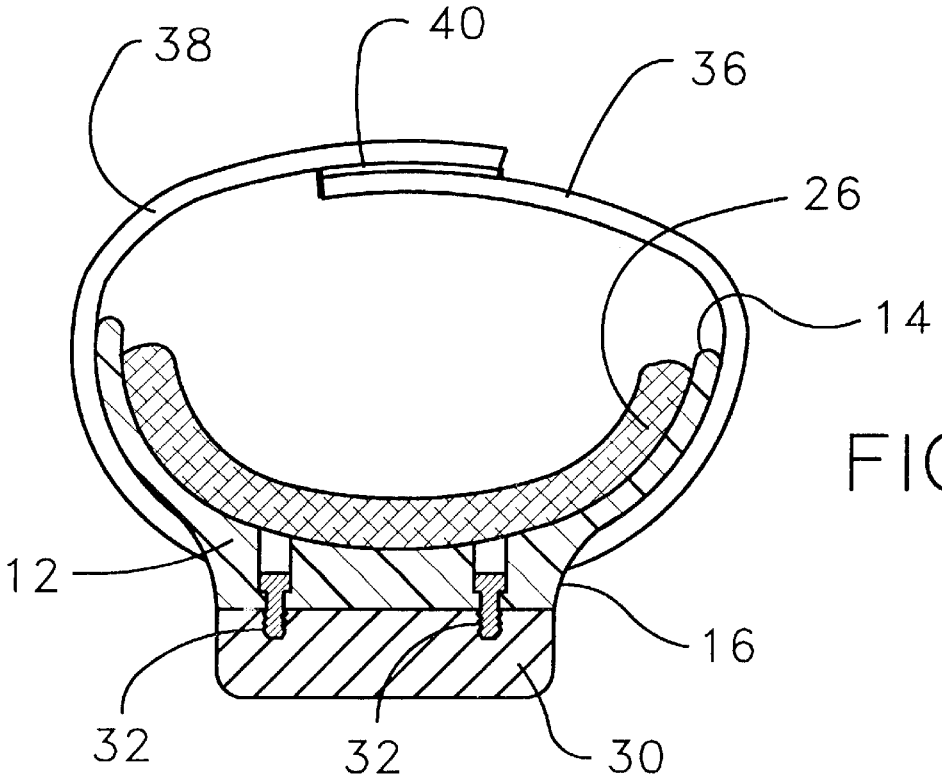
FIG. 4 is a schematic cross-sectional view of the present invention.

With reference now to the drawings, and in particular to FIGS. 1 through 4 thereof, a new knee protecting device embodying the principles and concepts of the present invention and generally designated by the reference numeral 10 will be described.

As best illustrated in FIGS. 1 through 4, the knee protecting device 10 generally comprises a rigid panel 12 having an inner surface 14 and an outer surface 16. The panel 12 has a first end edge 18, a second end edge 20, a first side edge 22 and a second side edge 24. The panel 12 is arcuate from the first side edge 22 to the second side edge 24 such that a cross-section of the panel 12 taken transversely to a line extending between the first 18 and second 20 end edges generally has an arcuate shape. The panel has a plurality of apertures 28 therein for allowing air through the panel 12. A cushioning member 26 is attached to the inner surface 14 of the panel 12 and is positioned adjacent to the first end edge 18.

A pad 30 is attached to the outer surface 16 and is positioned generally adjacent to the first end edge 18. A plurality of fasteners 32 extends through the panel 12 and into the pad 30. The pad 30 preferably comprises an elastomeric material. The pad 30 has a height from an outer surface to the panel 12 greater than ½ inch.

A plurality of securing members 34 is attached to the panel 12 for removably securing the panel 12 to a leg 70. Each of the securing members 34 comprises a strap having a first portion 36 and a second portion 38. Each of the first portions 36, 38 is attached to the outer surface 16 and positioned adjacent to the first side edge 22. Each of the second portions 38 is attached to the outer surface 16 and positioned adjacent to the second side edge 24. Each of a plurality of fastening means 40 removably fastens each of the first portions 36 to a respective one of the second portions 38. Each of the fastening means 40 ideally comprises a hook and loop fastening means. The plurality of securing members 34 comprises a pair of securing members 34.

In use, the device 10 is placed on the leg 70 of a user between the knee and the foot. The pad 30 is positioned just below the knee such that the pad maintains the knee in a position off of the ground surface. The cushioning member 26 adds additional comfort to the leg.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A knee guard device for removing pressure from the knee, said device being removably positionable on a shin portion of a leg, said device comprising:

a rigid panel having an inner surface and an outer surface, said panel having a first end edge, a second end edge, a first side edge and a second side edge;

a pad being attached to said outer surface and being positioned generally adjacent to said first end edge;

wherein said pad comprises an elastomeric material;

wherein said pad has a height from an outer surface to said panel greater than ½ inch; and a plurality of securing members being attached to said panel for removably securing said panel to the leg.

2. The knee guard device as in claim 1, wherein said panel is arcuate from said first side edge to said second side edge such that a cross-section of said panel taken transversely to a line extending between said first and second end edges generally has an arcuate shape.

3. The knee guard device as in claim 2, further including a cushioning member being attached to said inner surface of said panel.

4. The knee guard device as in claim 1, wherein each of said securing members comprising a strap having a first portion and a second portion, each of said first portions being attached to said outer surface and positioned adjacent to said first side edge, each of said second portions being attached to said outer surface and positioned adjacent to said second side edge, each of a plurality of fastening means removably fastens each of said first portions to a respective one of said second portions.

5. A knee guard device for removing pressure from the knee, said device being removably positionable on a shin portion of a leg, said device comprising:

a rigid panel having an inner surface and an outer surface, said panel having a first end edge, a second end edge, a first side edge and a second side edge, said panel being arcuate from said first side edge to said second side edge such that a cross-section of said panel taken transversely to a line extending between said first and second end edges generally has an arcuate shape, said panel having a plurality of apertures extending therethrough;

a cushioning member being attached to said inner surface of said panel, said cushioning member being positioned generally adjacent to said first end edge;

a pad being attached to said outer surface and being positioned generally adjacent to said first end edge, a plurality of fasteners extending through said panel and into said pad, said pad comprising an elastomeric material, said pad having a height from an outer surface to said panel greater than ½ inch; and a plurality of securing members being attached to said panel for removably securing said panel to the leg, each of said securing members comprising a strap having a first portion and a second portion, each of said first portions being attached to said outer surface and positioned adjacent to said first side edge, each of said second portions being attached to said outer surface and positioned adjacent to said second side edge, each of a plurality of fastening means removably fastens each of said first portions to a respective one of said second portions, each of said fastening means comprising a hook and loop fastening means, wherein said plurality of securing members comprises a pair of securing members.

* * * * *